US007568965B2

(12) United States Patent
Toriyama et al.

(10) Patent No.: US 7,568,965 B2
(45) Date of Patent: Aug. 4, 2009

(54) TRANSFORMABLE TOY AND LEG STRUCTURE FOR TOYS

(75) Inventors: Ryosuke Toriyama, Kanagawa (JP); Tetsuro Itami, Tokyo (JP); Shinichi Hanamoto, Tokyo (JP); Koji Okamoto, Kanagawa (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 372 days.

(21) Appl. No.: 10/597,163

(22) PCT Filed: Jan. 14, 2005

(86) PCT No.: PCT/JP2005/000409

§ 371 (c)(1),
(2), (4) Date: Jul. 13, 2006

(87) PCT Pub. No.: WO2005/068035

PCT Pub. Date: Jul. 28, 2005

(65) Prior Publication Data

US 2008/0233833 A1 Sep. 25, 2008

(30) Foreign Application Priority Data

Jan. 14, 2004 (JP) ..... 2004-007402
Feb. 9, 2004 (JP) ..... 2004-032762
Feb. 9, 2004 (JP) ..... 2004-032763

(51) Int. Cl.
*A63H 13/00* (2006.01)
*A63H 17/00* (2006.01)
*A63H 3/04* (2006.01)
*A63H 3/12* (2006.01)

(52) U.S. Cl. ..... 446/279; 446/94; 446/376; 446/321

(58) Field of Classification Search ..... 446/279, 446/94, 376, 321
See application file for complete search history.

(56) References Cited

U.S. PATENT DOCUMENTS 4,578,046 A * 3/1986 Ohno ..... 446/376
6,514,119 B1 * 2/2003 Lee et al. ..... 446/384

FOREIGN PATENT DOCUMENTS

JP 60-29176 2/1985
JP 60-43283 3/1985

(Continued)

*Primary Examiner*—Gene Kim
*Assistant Examiner*—Michael D Dennis
(74) *Attorney, Agent, or Firm*—Rankin, Hill & Clark LLP

(57) ABSTRACT

The present invention provides a transformable toy with which the user can enjoy the transforming process of the figure of the toy much more than ever. A movable toy includes an assembly composed of a plurality of components. The assembly is mounted onto an upper body of a toy doll to constitute an exterior 30 for the upper body of a toy robot. The assembly includes a first assembly constituent section, a second assembly constituent section, and a third assembly constituent section. The first assembly constituent section (13A, 14, 15) is disposed in a front side of the toy doll. The second assembly constituent section (11, 13B, 17) is connected to the first assembly constituent section and disposed in a back side of the toy doll. A handle (16A, 16B) composing the third assembly constituent section connects the first and second assembly constituent sections. The first, second and third assembly constituent sections are assembled together in an annular shape to constitute the exterior 30.

12 Claims, 15 Drawing Sheets

FOREIGN PATENT DOCUMENTS

| | | | |
|---|---|---|---|
| JP | 60-102092 | | 7/1985 |
| JP | 61-45993 | | 3/1986 |
| JP | 62-129074 | | 6/1987 |
| JP | 64-20891 | | 2/1989 |
| JP | 1-77094 | | 5/1989 |
| JP | 5-195 | | 1/1993 |
| JP | 60-102092 A | * | 7/1995 |
| JP | 10-005447 | | 1/1998 |
| JP | 10-057633 | | 3/1998 |
| JP | 3077559 | | 2/2001 |
| JP | 3079299 | | 5/2001 |
| JP | 2003-266362 | | 9/2003 |

* cited by examiner

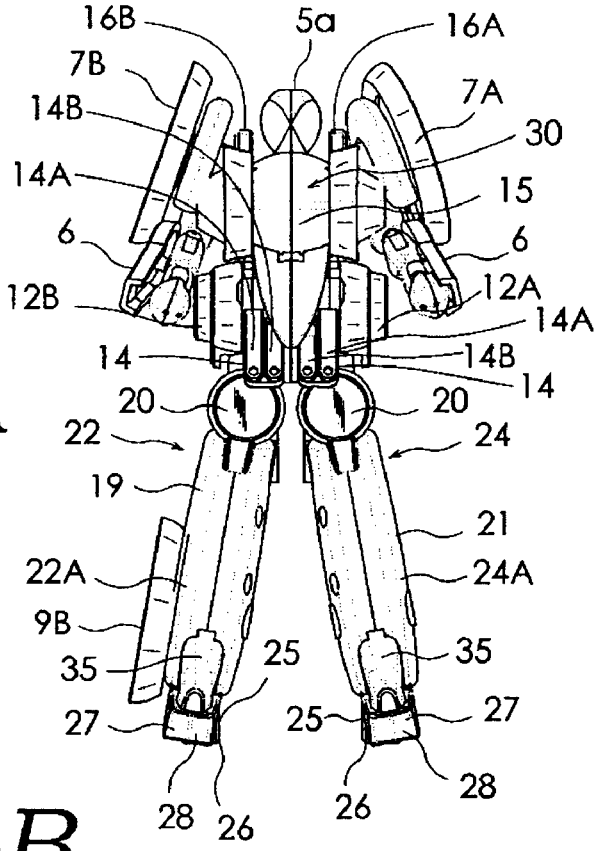
Fig.4A
Fig.4B
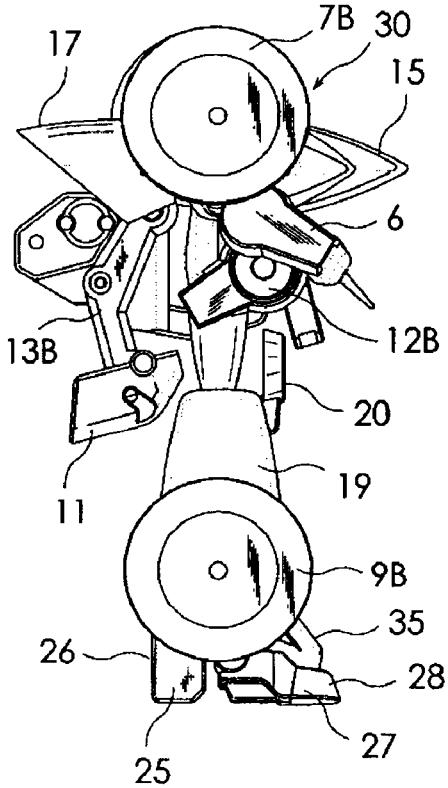
Fig.4C
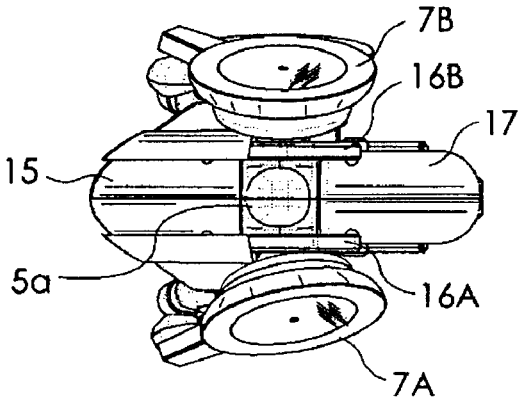

TRANSFORMABLE TOY AND LEG STRUCTURE FOR TOYS

TECHNICAL FIELD

The present invention relates to a transformable toy, of which the figure can be changed from a state in which a toy doll is riding on a movable toy to a toy robot having a configuration different from that of the toy doll, and also relates to a toy foot structure used in the toy robot, and further relates to a transformable toy provided with the toy foot structure.

BACKGROUND ART

Japanese Utility Model Laid-Open Publication No. H05-195 (Patent Document 1) shows an example of a transformable toy capable of changing its figure from a state where a toy doll is riding on a movable toy to a toy robot having a configuration different from that of the toy doll by transforming at least a part of the movable toy and mounting it on the toy doll. In this disclosure, the toy robot is constituted merely by disassembling the movable toy to obtain an assembly constituent section and mounting the obtained constituent section onto the toy doll.

Japanese Utility Model Laid-Open Publication No. S60-102092 (Patent Document 2), Japanese Utility Model Laid-Open Publication No. S61-77094 (Patent Document 3), and Japanese Utility Model Laid-Open Publication No. S64-20891 (Patent Document 4) show examples of a transformable toy constituting a toy robot by transforming an autobicycle.

FIG. 2 of Japanese Utility Model Laid-Open Publication No. S61-45993 shows an example of a toy foot structure in which a foot having a tiptoe and a heel is mounted to a shin section in such a manner that the foot section can incline and move in a back and forth direction with respect to the shin section. This conventional toy foot structure is applied to a doll-type toy robot which opens its pair of leg sections back and forth, enabling the tiptoe and the heel of the foot to be always in full contact with a setting surface when the pair of leg sections are opened back and forth.

FIGS. 1 through 3 of the Utility Model Registration Publication No. 3079299 show an example of a toy foot structure in which an ankle includes a spherical portion, a shin section includes a spherical seat for receiving the spherical portion so that a foot can freely rotate with respect to the shin section.

[Patent Document 1]
Japanese Utility Model Laid-Open Publication No. H05-195, FIGS. 1-10

[Patent Document 2]
Japanese Utility Model Laid-Open Publication No. S60-102092, FIG. 5

[Patent Document 3]
Japanese Utility Model Laid-Open Publication No. S61-77094, FIGS. 2, 3

[Patent Documents 4]
Japanese Utility Model Laid-Open Publication No. S64-20891, FIG. 3

[Patent Document 5]
Japanese Utility Model Laid-Open Publication No. S61-45993, FIG. 2

[Patent Document 6]
Utility Model Registration Publication No. 3079299, FIGS. 1-3

DISCLOSURE OF THE INVENTION

Problem to be Solved by the Invention

In the transformable toy shown in Patent Documents 1, since the transformation is carried out in a comparatively simple way, namely, merely by equipping the toy doll with the assembly constituent section obtained merely by disassembling the movable toy, there is a limitation in enjoying the transformation process.

There is also another problem that an unpredictable transformation can be hardly expected. In the case of the structure described in Japanese Utility Model Laid-Open Publication No. S61-45993, when the pair of leg sections are opened right and left, only the inner edges of the tiptoes and the heels are in contact with the setting surface. Therefore, when the conventional structure is applied to the doll-type toy robot which is constructed to open its pair of leg sections right and left, there occurs a problem that it is difficult to keep a well-stabilized standing condition for the toy robot.

As compared with that, if the structure described in the Utility Model Registration Publication No. 3079299 is employed, even when the pair of leg sections are opened right and left, the soles of the feet can be always in full contact with the setting surface. However, in the joint structure using the combination of the spherical portion and the spherical seat, a slip easily occurs between the spherical portion and the spherical seat just by a small force applied from the outside. Thus, it is difficult to keep a well-stabilized standing condition for the toy robot with the pair of legs opened. Moreover, with the joint structure using the combining of the spherical portion and the spherical seat, it is impossible to constrain the feet and the shin sections in a particular positional relationship in order to always attain the particular positional relationship. Therefore, if the structure is employed for connecting a foot to a shin section of a transformable toy, when portions used as a foot or a shin section in the transformable toy are used for a certain component in the after-transformed figure, there occurs a problem that a degree of freedom in designing the transformable toy will be limited since it is hard to fix the connecting state between the portions used as the foot and the shin section.

An object of the present invention is accordingly to provide a transformable toy with which an unprecedented transforming process can be enjoyed.

Another object of the present invention is to provide a transformable toy in which a movable toy carries out an unpredictable transformation.

A further object of the present invention is to provide a transformable toy in which a transformation process can be fully enjoyed in making an exterior to be mounted on a toy doll by transforming an assembly constituent section constituting an autobicycle.

Still another object of the present invention is to provide a transformable toy in which a fuel tank of the autobicycle does not get in the way of transformation.

Yet another object of the present invention is to provide a transformable toy in which an exterior composed of an assembly constituent section of a movable toy is hardly separated from a toy doll.

Even another object of the present invention is to provide a toy foot structure which enables a toy to keep standing in a more stabilized condition than ever even when the toy doll opens its legs right and left.

A still further object of the present invention is to provide a transformable toy having a toy foot structure capable of achieving the above-mentioned object without reducing a degree of freedom in designing the transformable toy.

MEANS FOR SOLVING THE PROBLEM

The present invention is directed to a transformable toy, the figure of which can be changed from a state where a toy doll is riding on a movable toy (such as a two-wheeled vehicle) to a toy robot having a configuration different from that of the toy doll by transforming at least a part of the movable toy and mounting it on the toy doll. The movable toy typically includes any of an autobicycle, a bicycle, an automobile, a motorboat, and an airplane. The toy doll may not be limited to a doll of human being's figure, and may be a figure of robot by itself. A movable toy includes an assembly which is composed of a plurality of components, and is mounted onto an upper body of the toy doll to constitute an exterior for an upper body of the toy robot. The assembly includes a first assembly constituent section, a second assembly constituent section, and a third assembly constituent section, each of which is composed of one or more components. The first assembly constituent section is mainly disposed in a front side of the toy doll. The second assembly constituent section is connected to the first assembly constituent section and disposed in a back side of the toy doll. The third assembly constituent section connects the first and second assembly constituent sections. The first, second and third assembly constituent sections are assembled together in an annular shape to constitute the exterior of the toy doll. The exterior surrounds at least shoulders, a crotch, the front side and the back side of the toy doll. There is no annular exterior configuration in the past, and there is also no such transformation process as constituting the above-mentioned exterior in the past. Therefore, according to the transformable toy of the present invention, unprecedented process of transformation can be enjoyed. In addition, unexpected transformation of the assembly which constitutes a part of the movable toy can increase the user's interest in the transformable toy.

In particular, if the third assembly constituent section is disposed on the shoulders of the toy doll so that a head section of the toy doll can be exposed, the head section of the toy doll can be used as a head of the toy robot as it is. In addition, just an easy work of surrounding a main part (doll body part) of the toy doll with the assembly can firmly mount the exterior having a sense of robustness onto the upper body of the toy doll. Still more, since the head section exposed from the third assembly constituent section works as a positioning means and a movement prevention means at the time of attaching the assembly to the toy doll, such an advantage can be obtained that the assembly can be easily mounted onto the toy doll. Those components constituting the movable toy may include a pair of shin section constituents composed of one or more components. The pair of shin section constituents are attached to a pair of leg sections of the toy doll, and constitute shin sections of the pair of leg sections for the toy robot. If the pair of the shin section constituents are attached to the toy doll, even when the upper body of the toy doll is equipped with a comparatively big exterior, it becomes possible to make a good balance between a weight of the lower body of the toy robot and a weight of the upper body of the toy robot. As a result, stability of the toy robot can be increased.

When the movable toy is an autobicycle, the first assembly constituent section may include a front cover, a front fork, and a front frame of the autobicycle. The second assembly constituent section may include a fuel tank, a sitting portion, a rear frame, and a rear cover. The third assembly constituent section may include a handle. In this case, at least the front frame and the rear frame are rotatably connected, and the fuel tank is constituted by assembling two tank half portions that can be separated apart right and left. The two tank half portions are attached to the rear frame in such a manner that the front frame can pass through between the two tank half portions which are separated apart left and right when assembling the first, second and third assembly constituent sections in the annular shape. If the first through third assembly constituent sections are assembled together in this way, when the annular exterior is formed, the tank half portions of the fuel tank are opened right and left. Since the front frame can be rotated in a direction toward the rear frame through a clearance made between the two tank half portions, the presence of the fuel tank does not get in the way in constituting the annular exterior.

Preferably, an engaged portion, which is a recessed or raised portion, is arranged in the back side of the toy doll. In this case, a cover part of the rear cover, which is located by the side of the sitting portion, is supported by a rear cover body of the rear cover in such a manner that the cover part can be turned over. An engaging portion engaging with the engaged portion of the toy doll is arranged in a turned-over side of the cover part. In this way, the exterior can be mounted onto the toy doll without causing loosening between the exterior and the toy doll by engaging the engaged portion arranged in the back side of the toy doll and the engaging portion arranged in the rear cover side. In particular, since the cover part of the rear cover can be turned over, when the toy is not transformed into the toy robot, the presence of the engaging portion does not get in the way.

When a handle is included in the third assembly constituent section, a construction of the handle and a construction of the rear cover are defined so that end portions of a pair of arm parts of the handle can engage with the rear cover to constitute the exterior in the annular shape, and the handle can be located over the shoulders of the toy doll. In this way, the head section of the toy doll can be exposed from between the pair of arm parts of the handle. What is more, the head section of the toy doll can be used as it is as a head of the toy robot.

Preferably, the front frame and the front fork are connected to rotate in a predetermined angular range and the rear frame and the rear cover are connected to rotate in a predetermined rotation range. In this manner, the number of rotatable connecting components included in the annular exterior will increase. As a result, transformation of the annular exterior becomes easy and what is more, the annular exterior can be transformed substantially in accordance with the shape of the upper body of the toy doll.

As the pair of shin section constituents, a pair of muffler constituent sections of the autobicycle may be used. Each of two wheels of the autobicycle may be constructed to be divided into two parts in a direction orthogonal to the wheel's axle to form wheel half portions. In this case, the wheel half portions of the two wheels are mounted onto the exterior and/or both of the shin sections of the toy robot respectively. In this manner, the tires can be mounted onto the toy robot as if they were a part of armor thereof. As a result, an image of the autobicycle before transformation can be considerably faded out and deformation degree of the transformable toy can be further increased.

The present invention is also directed to a toy foot structure in which a foot having a tiptoe section and a heel section is attached to under a shin section. In the specification of the present invention, the tiptoe means a part of the foot except the heel, the main part or the whole portion situated ahead of the heel within the foot section. In the present invention, a heel mounting mechanism comprises a foot section having a tiptoe section and a heel section, and a heel mounting mechanism that attaches the heel section to the shin section. The heel mounting mechanism is constructed in such a manner that the heel section can move with respect to the shin section so that a whole bottom face of the heel can be in full contact with a setting surface whenever the shin section stands erect or the shin section is inclined in a lateral direction as seen from the tiptoe side. According to the present invention, the whole bottom face of the heel section is always in full contact with the setting surface whether or not the shin section is inclined, and at least a part of the end portions of the tiptoe section comes into contact with the setting surface when the shin section is inclined. As a result, according to the present invention, the two sections, the heel and the tiptoe, can always be in contact with the setting surface in principle. The full contact between the bottom face of the heel and the setting surface contributes to maintaining a stable, stationary position when the toy stands with its leg sections opened. The contact between the tiptoe and the setting surface works to prevent the inclination of the shin sections from changing with a slight application of external force. As a result, according to the present invention, even when the toy is installed on the setting surface with the leg sections thereof opened, the toy can keep its standing state in a more stabilized way than ever.

Specifically, the heel mounting mechanism used in the present invention may be constructed in such a manner that the heel section can incline right and left with respect to the shin section as the shin section is seen from the tiptoe side (in other word, as the shin section is seen from the tiptoe side when the foot sections are installed on the setting surface). In this way, even if the shin section is inclined in a lateral direction, the bottom face of the heel section can always be in contact with the setting surface according to how the heel is inclined with respect to the shin section. As a more specific example of the heel mounting mechanism, the heel mounting mechanism may include a shaft orthogonal to a longitudinal direction of the shin section and extending in a direction where the tiptoe section and the heel section are disposed side by side so that the heel section can swing in a predetermined angular range with respect to the shaft. In this arrangement, the heel mounting mechanism can be constituted by merely a few number of components. Alternatively, in this case, if the shaft is constituted integrally with the heel section and the shin section includes a shaft supporting structure rotatably supporting the shaft, the heel mounting mechanism can be easily assembled.

The heel mounting mechanism may be constituted in such a manner that the heel section can be inclined back and forth with respect to the shin section as the shin section is seen from the tiptoe side. In order to realize the foregoing movement, the heel section may be attached to the shin section using a spherical portion and a spherical seat as shown in FIGS. 1 through 3 of the Utility Model Registration Publication No. 3079299, for example. Even if configured in this way, in the present invention, a part of the tiptoe section is in contact with the setting surface independently of the heel section. Therefore, the heel mounting mechanism does not move even when a slight external force is applied.

The toy foot structure of the present invention can be applied to a transformable toy, the figure of which can be changed from a state where a toy doll is riding on a movable toy (such as a two-wheeled vehicle) to a toy robot having a configuration different from that of the toy doll by transforming a part of the movable toy and mounting it on the toy doll. In the transformable toy, the movable toy includes at least a pair of shin section constituents composed of one or more components and attached to a pair of leg sections of the toy doll to constitute shin sections of the pair of leg sections for the toy robot, and an assembly composed of a plurality of components and attached to an upper body of the toy doll to constitute an exterior for an upper body of the toy robot. Preferably, the assembly includes a first assembly constituent section mainly disposed in a front side of the toy doll; a second assembly constituent section connected to the first assembly constituent section and disposed in a back side of the toy doll; and a third assembly constituent section connecting the first and second assembly constituent sections. Each of the first, second and third assembly constituent sections are composed of the one or more components. The first, second and third assembly constituent sections are preferably assembled together in an annular shape to constitute the exterior of the toy doll. The exterior surrounds at lest shoulders, a crotch, the front side and the back side of the toy doll. In such a transformable toy as described above, the pair of shin section constituents are deformably constituted to form a toy foot structure that includes a shin section and a foot section having a tiptoe section and a heel section for the toy robot. In this way, the exterior having a sense of robustness can be firmly mounted onto the upper body of the toy doll. Still more, since the head section exposed from the third assembly constituent section works as a positioning means and a movement preventing means at the time of attaching the assembly to the toy doll, such an advantage can be obtained that the assembly can easily be attached to the toy doll. If the pair of the shin section constituents are mounted onto the toy doll, even when the upper body of the toy doll is equipped with a comparatively big exterior, it becomes possible to make a good balance between a weight of the lower body of the toy robot and a weight of the upper body of the toy robot. As a result, stability of the toy robot can be increased.

In the transformable toy, the toy foot structure of the present invention is employed as a heel mounting mechanism that attaches the heel section to the shin section. Namely, the heel mounting mechanism is constructed in such a manner that the heel section can move with respect to the shin section so that a whole bottom face of the heel section can be in full contact with a setting surface whenever the pair of leg sections of the toy robot are opened right and left, or closed, as seen from the front. In this manner, even when the toy robot having a heavily mounted upper body is installed on the setting surface with its leg sections opened, it is possible to keep the toy standing in a stabilized condition.

Alternatively, in the present transformable toy, if the heel mounting mechanism includes a shaft orthogonal to a longitudinal direction of the shin section and extending in a direction where the tiptoe section and the heel section are disposed side by side so that the heel section can swing in a predetermined angular range with respect to the shaft, the movement of the heel section is restrained by the shaft. Therefore, a configuration for fixing the shin section, the tiptoe section and the heel section in a predetermined shape in order to constitute a part of the movable toy can be simplified.

When the movable toy is autobicycle, each of two wheels of the autobicycle has a construction that can be divided into two parts in a direction orthogonal to the wheel's axle to form wheel half portions. The wheel half portions of the two wheels are mounted onto the exterior and/or both of the shin sections of the toy robot respectively. In this manner, the tires can be mounted onto the toy robot as if they were a part of armor of the toy robot. As a result, an image of the autobicycle before transformation can considerably be faded out and deformation degree of the transformable toy can be further increased.

BRIEF DESCRIPTION OF THE DRAWINGS

FIGS. 4A through 4C are a front elevation view, a left side view, and a plan view of the toy robot.

BEST MODE FOR CARRYING OUT THE INVENTION

Figure 1A:
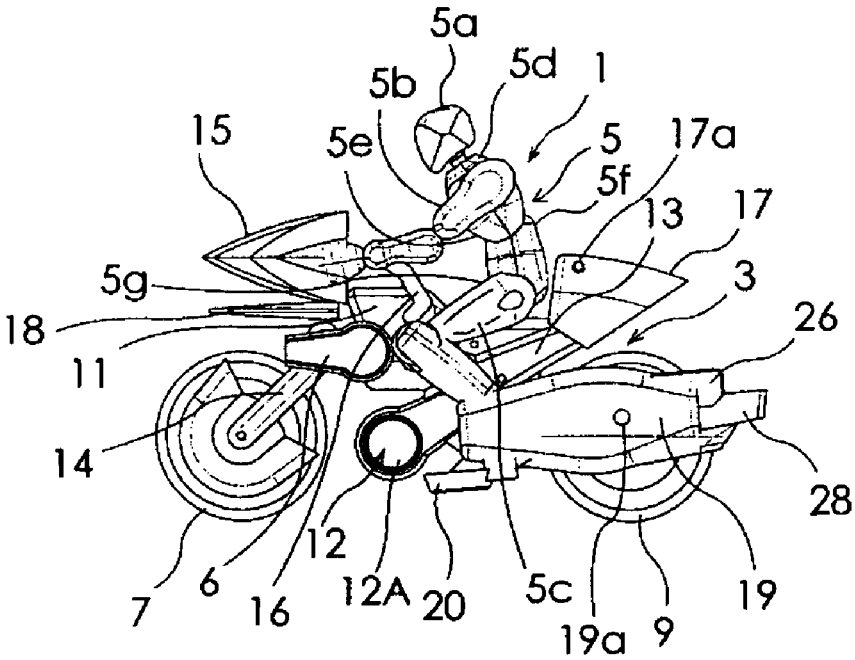
FIGS. 1A through 1D are a side elevation view, a front elevation view, a back elevation view, and a plan view of a transformable toy of the present invention.
Figure 1B:
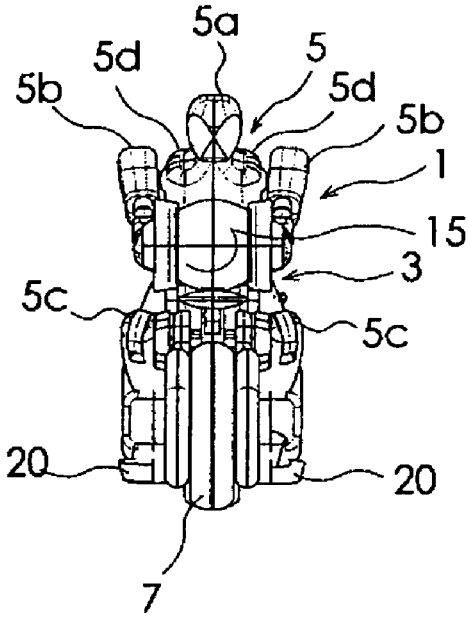
Figure 1C:
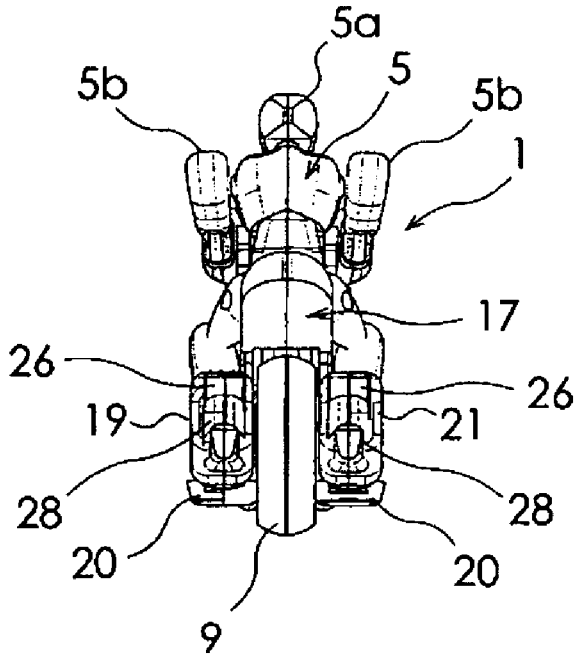
Figure 1D:
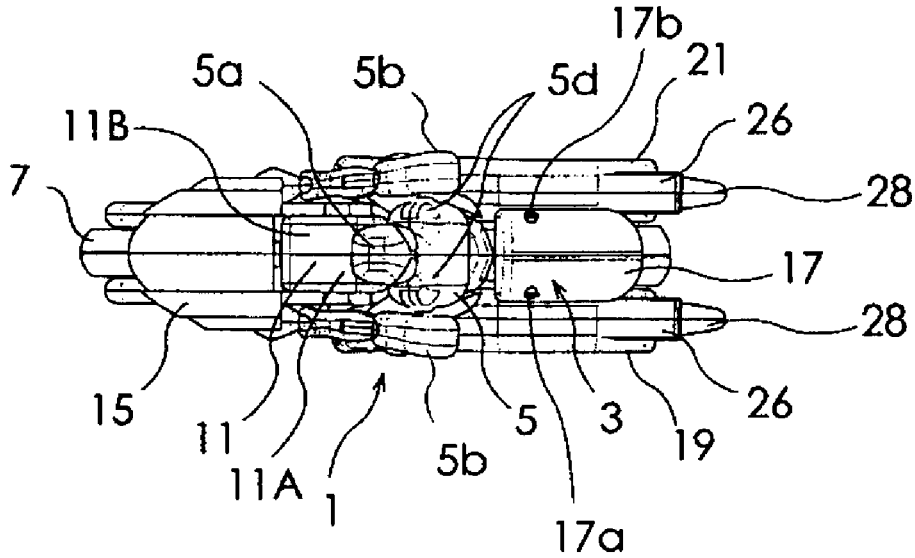
Figure 2A:
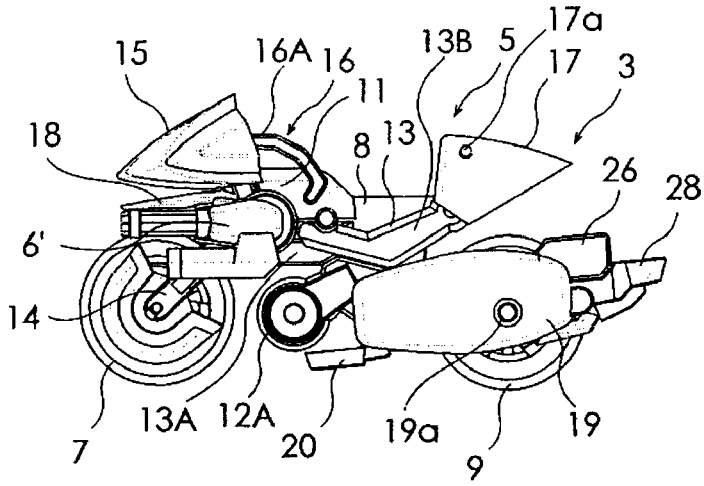
FIGS. 2A through 2C are a side elevation view, a front elevation view, and a plan view of an autobicycle.
Figure 2B:
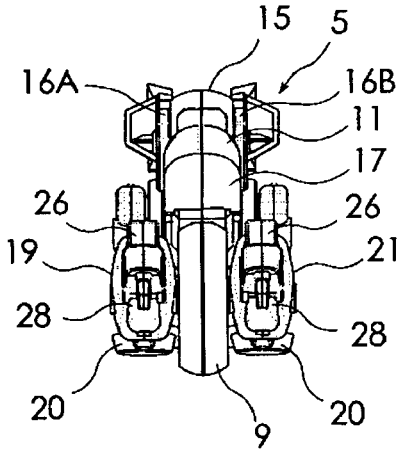
Figure 2C:
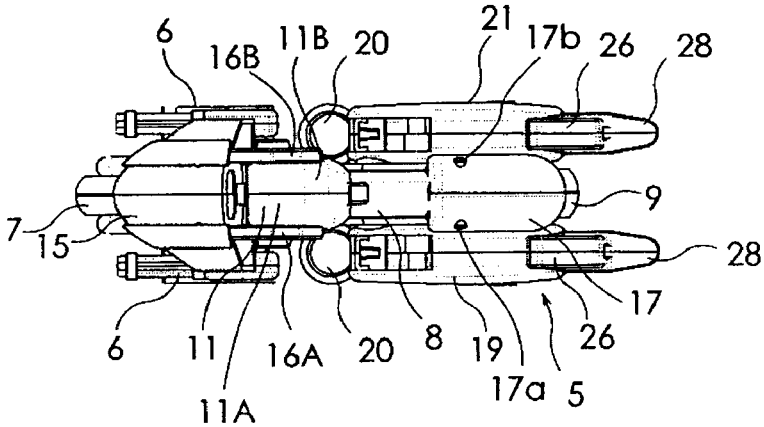
Figure 3A:
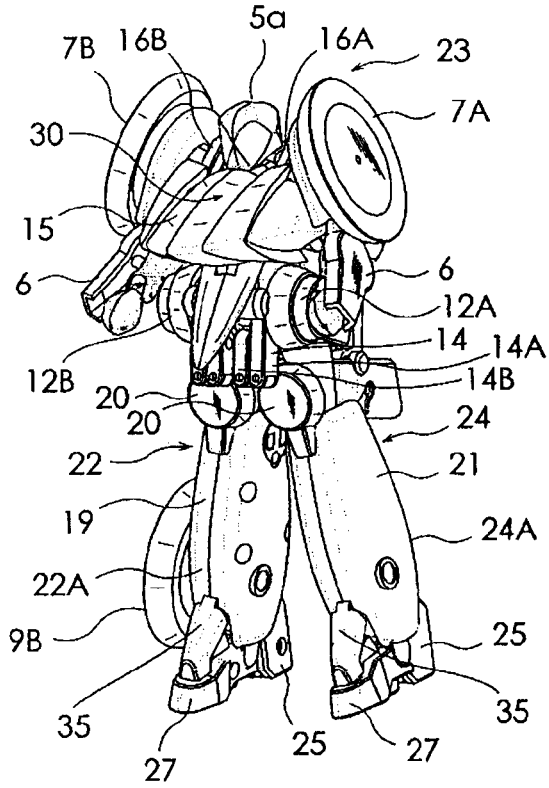
FIGS. 3A and 3B are a perspective views as seen diagonally from an upper right side and from a lower left side respectively, of a toy robot after transformation.
Figure 3B:
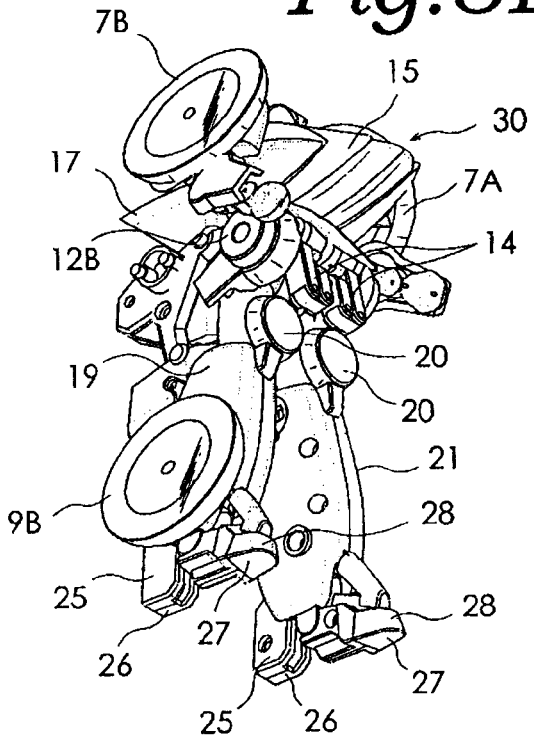

Embodiments of the present invention will now be described in detail hereinafter by referring to the accompanying drawings. FIGS. 1A through 1D are a side elevation view, front elevation view, back elevation view, and plan view of a transformable toy 1 of the present invention. A transformable toy 1 is transformed from a toy doll 5 riding on an autobicycle (movable toy) 3 into a toy robot (FIG. 3) having a configuration different from that of the toy doll 5 by disassembling and transforming a part of the autobicycle 3 and mounting it onto the toy doll 5. FIGS. 2A through 2C are a side elevation vie w, front elevation view, and plan view of the autobicycle 3. FIGS. 3A and 3B are perspective views of an after-transformed toy robot 23 as seen diagonally from an upper right and lower left respectively, and FIGS. 4A through 4C are a front elevation view, left side view, and plan view of the toy robot 23.

In these views, the autobicycle (movable toy) 3 has two wheels 7 and 9, a chassis 13 provided with a fuel tank 11 and an engine 12, a front fork 14, a front cover 15, a handle 16, a rear cover 17, a tire cover 18, two muffler constituent sections 19 and 21 provided respectively with a step part 20, accessories 6, and a sitting portion 8. An example of the accessories 6 is a machine gun, and can be disassembled into a plurality of components. FIG. 1 shows a simplest example of accessories 6 and FIG. 2 shows a constitution of the accessories 6 that constitutes a machine gun. The back wheel 9 is supported in a sandwiched relation between the two muffler constituent sections 19, 21. The two muffler constituent sections 19, 21 have a fitting recess 19*a* respectively on their side faces for receiving wheel half portions (9A, 9B) which are constituted by dividing the wheel 9 into two, as will be explained later. FIGS. 3 and 4 illustrate only one 9B of the wheel half portions. The wheel 7 on the front side is also constituted by assembling wheel half portions (7A, 7B) which respectively correspond to a half of the wheel. As shown in FIGS. 3 and 4, the wheel half portions 7A and 7B are mounted onto the toy doll 5 by use of a fitting structure on the side faces of the shoulders of the toy doll 5, respectively.

A handle 16 disposed behind the front cover 15 includes a pair of arm parts 16A, 16B. As will be explained later, the pair of arm parts 16A and 16B have a pair of raised portions 16*a* and 16*b* (engaging portions) arranged integrally on end portions thereof that are engaged with a pair of recesses 17*a* and 17*b* (engaged portions) arranged on both sides of the rear cover 17. The pair of arm parts 16A, 16B are constituted to rotate or move up and down, and also right and left. The pair of arm parts 16A, 16B will be loaded respectively on the both shoulders of the toy doll 5 after transformation.

In this embodiment, the two muffler constituent sections 19, 21 constitute a pair of shin section constituents which constitute shin sections 22A, 24A of leg sections 22, 24 of the toy robot 23 when the muffler constituent sections 19, 21 are mounted onto the leg sections of the toy doll 5 as shown in FIGS. 3 and 4. The fuel tank 11, engine 12, chassis 13, front fork 14, front cover 15, handle 16, and rear cover 17 constitute an assembly which will be assembled in an annular shape and transformed into an exterior 30 for surrounding shoulders 5*d*, a front side 5*e*, a crotch 5*g* and a back side 5*f* of the doll body (upper body of the doll) except leg sections 5*c*, arm sections 5*b*, and a head section 5*a* of the toy doll 5.

The fuel tank 11 is constituted by two tank half portions 11A, 11B which are assembled together in such a manner that the tank half portions can be separated apart right and left, as will be explain in detail later. The two tank half portions 11A, 11B are rotatably attached to a rear frame 13B so that a front frame 13A, which will be described later, can pass through between the two tank half portions 11A and 11B that are divided right and left into two parts. The engine 12 includes a pair of engine constituent parts 12A, 12B mounted to the chassis 13. The chassis 13 includes the front frame 13A and the rear frame 13B, as shown in FIG. 2. The front frame 13A and the front fork 14 are connected to each other to rotate in a predetermined angular range. The rear frame 13B and the rear cover 17 are connected to each other to rotate in a predetermined rotation range. In this manner, the number of rotatable connecting components in the annular exterior 30, which will be mentioned later, increases, and consequently transformation of the annular exterior becomes easy.

Figure 5A:
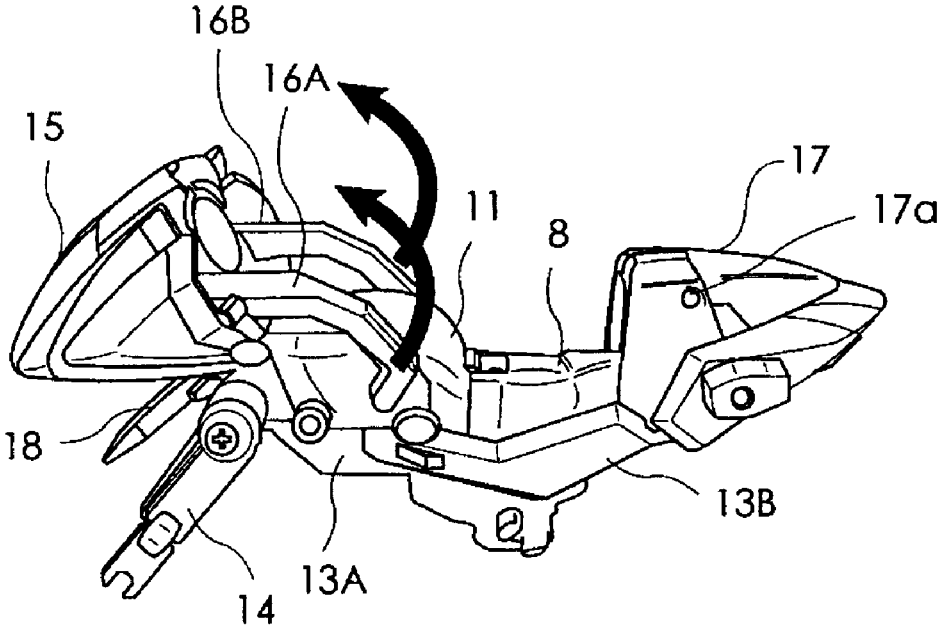
FIG. 5A is a perspective view showing a configuration of an assembly.

Hereinafter will be described the transformation process from the state shown in FIG. 1 into the toy robot as shown in FIGS. 3 and 4. First, in FIG. 1, the toy doll 5 is dismounted from the autobicycle 3, and a front wheel 7 is removed from the front fork 14. Next, one of the muffler constituent sections 19, 21 is dismounted, and then a back wheel 9 is removed from the other muffler constituent sections 19, 21. The remaining muffler constituent section is then dismounted. The accessories 6 and the engine constituent parts 12A, 12B are removed. FIG. 5A shows a figure as described above. FIG. 5A is a configuration of the assembly to be used for constituting the exterior 30 which will be mounted onto the upper body of the toy doll 5.

Figure 5B:
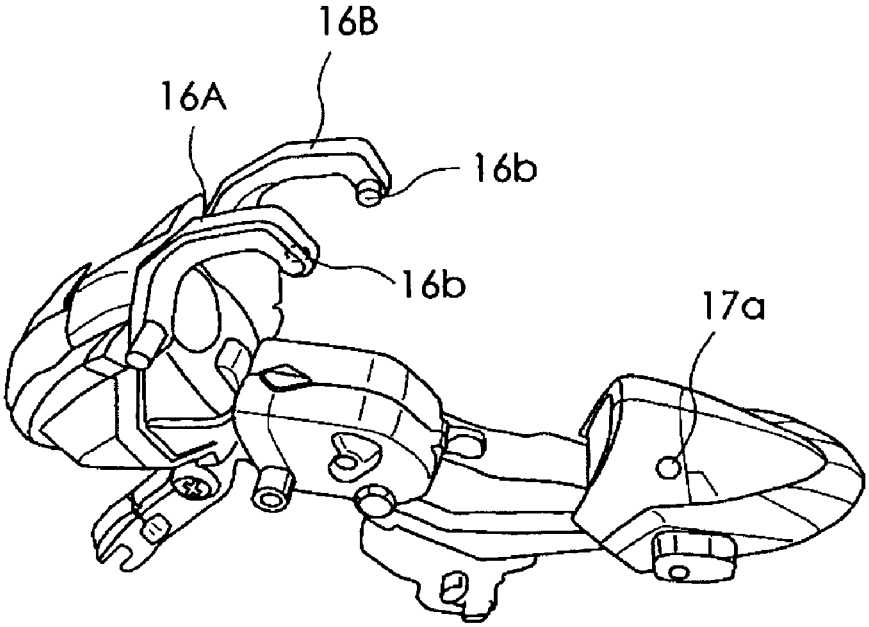
FIG. 5B is a perspective view of the assembly partially transformed from the state of FIG. 4A.
Figure 6A:
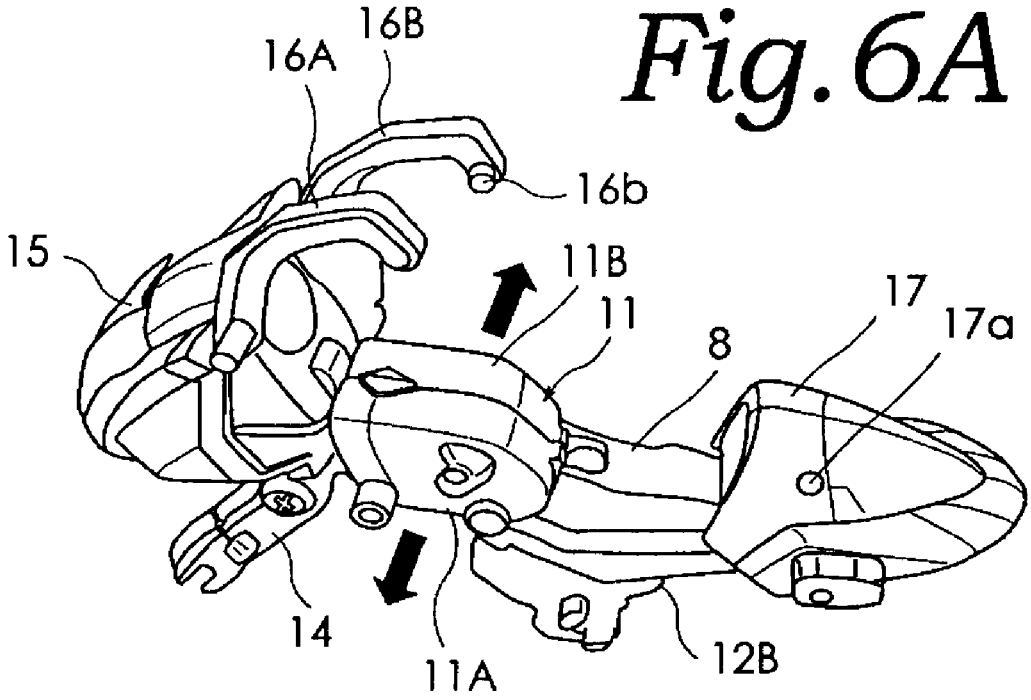
FIG. 6A is a perspective view of the assembly further transformed from the state of FIG. 5B.
Figure 6B:
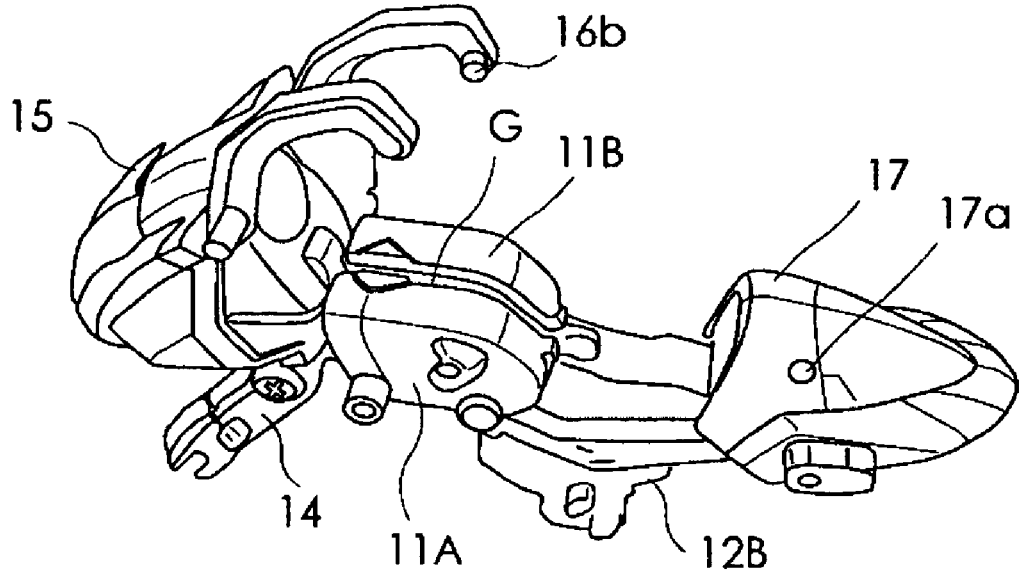
FIG. 6B is a perspective view of the assembly partially transformed from the state of FIG. 6A.

Next, as shown by thick arrows in FIG. 5A, the arm parts 16A, 16B of the handle 16 are rotated upward, and they are changed into a figure as shown in FIG. 5B. The tank half portions 11A, 11B of the fuel tank 11 are opened right and left as shown in FIGS. 6A and 6B. A clearance G which is formed between the two tank half portions 11A, 11B has such a width dimension as the front frame 13A can pass through the clearance (or the two tank half portions 11A, 11B may rotate counterclockwise along both sides of the front frame 13A).

Figure 7A:
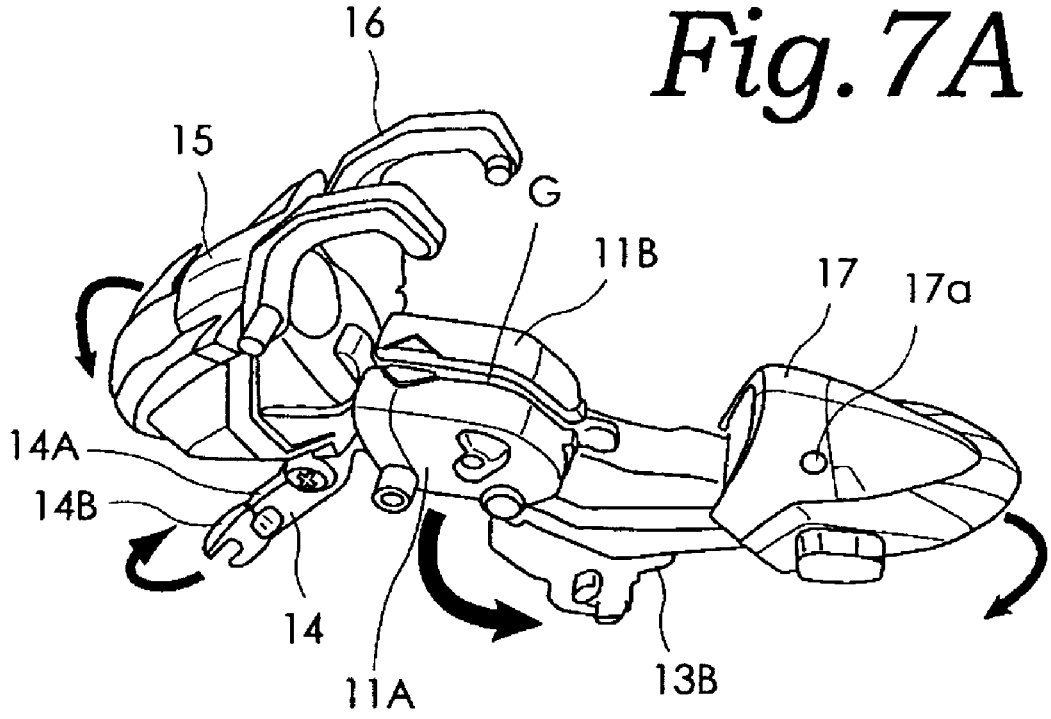
FIG. 7A is a perspective view of the assembly transformed from the state of FIG. 6B.
Figure 7B:
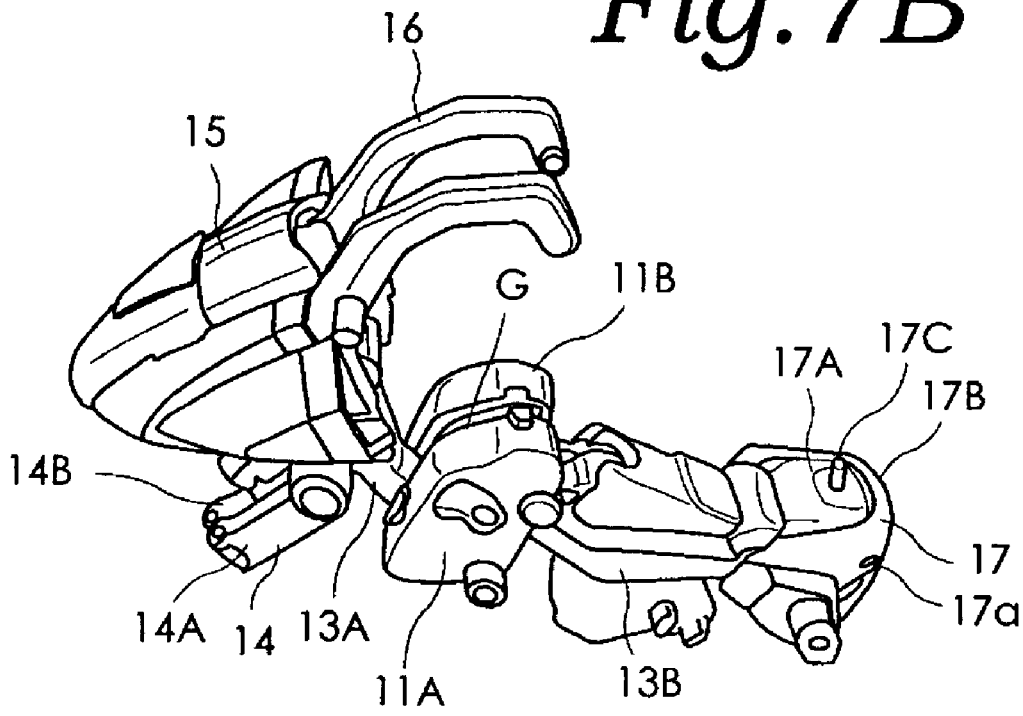
FIG. 7B is a perspective view of the assembly partially transformed from the state of FIG. 7A.

Next, as shown in FIG. 7A, the front cover 15 is rotated counterclockwise until the engagement between the front cover 15 and the fuel tank 11 is released, then the two tank half portions 11A, 11B are rotated counterclockwise along both sides of the front frame 13A as shown in FIG. 7B. The rear cover 17 is rotated clockwise with respect to the rear frame 13B. Two front forks 14 are bent inside at the middle portion at that time. The front fork 14 has a configuration in which two fork parts 14A and 14B are connected via a rotating mechanism. A cover part 17A of the rear cover 17, which is located by the side of the sitting portion, is supported by a rear cover body 17B in such a manner that the cover part can be turned over. The turned-over face of the cover part 17A has an engaging portion 17C that engages with an engaged portion (refer to the part shown in FIG. 9: 5*h*) arranged in the toy doll as will be mentioned later. FIG. 7(B) shows the cover member 17A which has been turned over.

Figure 8A:
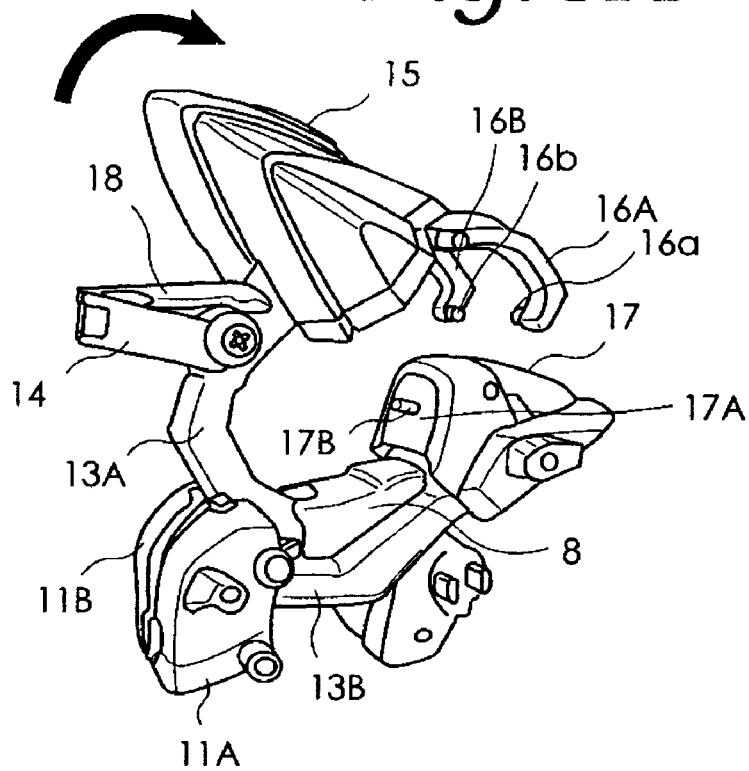
FIG. 8A is a perspective view of the assembly still further transformed from the state of FIG. 7B.
Figure 8B:
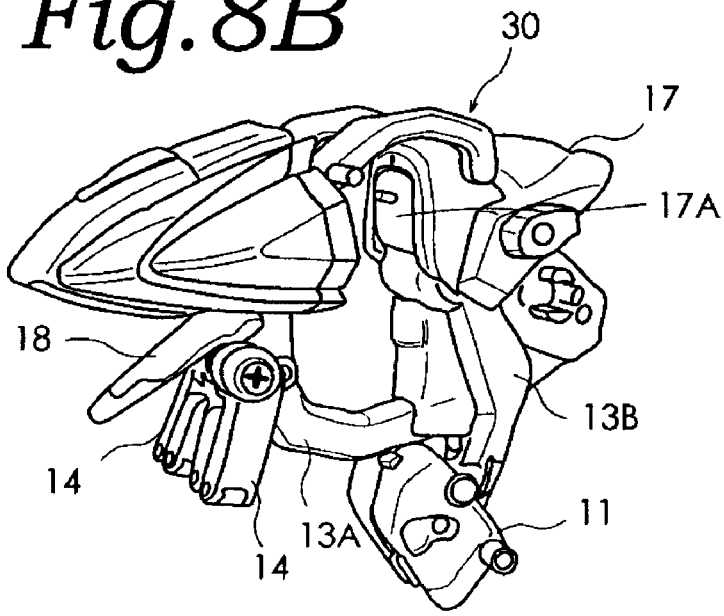
FIG. 8B is a perspective view of the assembly partially transformed from the state of FIG. 8A.

In assembling the annular exterior 30, the front cover 15 and the front frame 13A are further rotated to the extent that the raised portions 16*a* and 16*b* arranged at the end portions of the pair of arm parts 16A, 16B of the handle 16 fit into the recesses 17*a*, 17*b* arranged in rear cover 17, as shown in FIG. 8A. FIG. 8B shows the annular exterior 30 which has been completely assembled.

Figure 9:
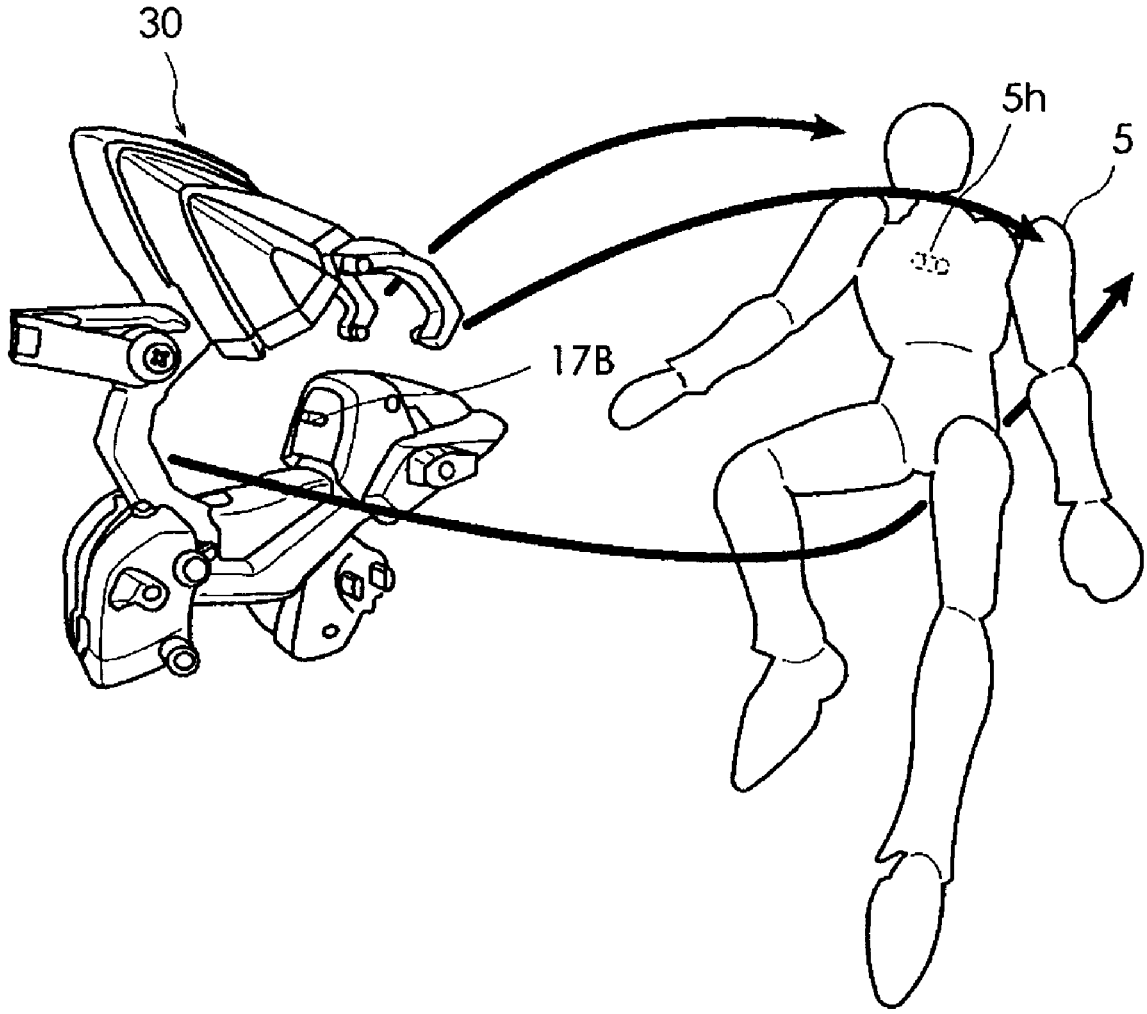
FIG. 9 is a view used to explain a case where the toy doll will be equipped with an exterior.
Figure 10:
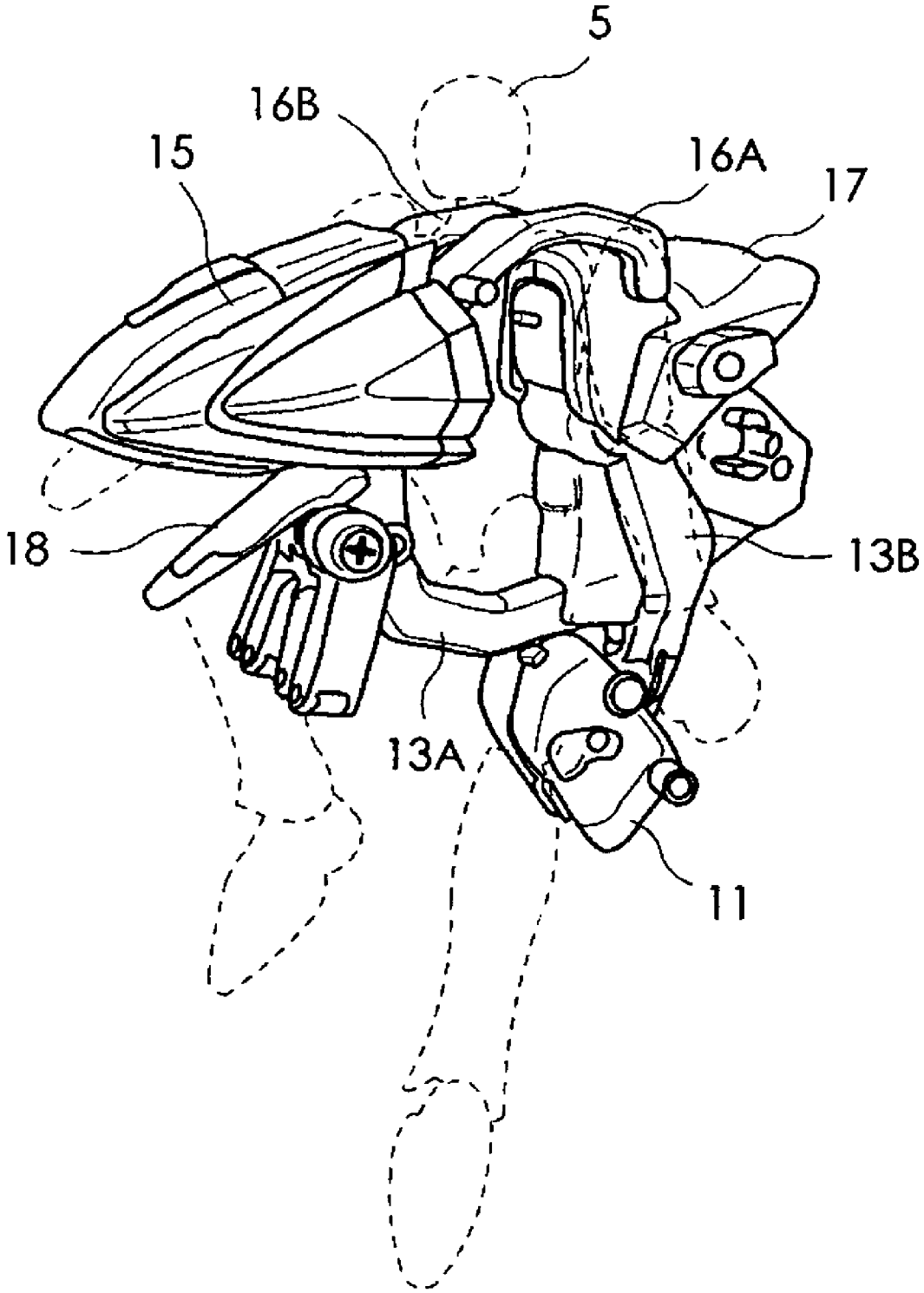
FIG. 10 is a view used to explain a case where the toy doll has been equipped with the exterior.

In order to mount the exterior 30 onto the toy doll 5, the toy doll 5 is inserted in an interior of the exterior 30 before connecting the pair of arm parts 16A, 16B of the handle 16 to the rear cover 17 as shown in FIGS. 9 and 10. The toy doll is arranged so that the crotch of the toy doll 5 may ride on the front frame 13A, and the pair of arm parts 16A, 16B may be disposed on both shoulders of the toy doll 5. The engaged portion 5*h* formed of a fitting recess arranged in the back of the toy doll 5 is engaged with the pin-shaped engaging portion 17C arranged on the turned-over face of the cover part 17A of the rear cover 17 located by the side of the sitting portion at this time. In this manner, positioning of the toy doll 5 with respect to the exterior 30 is completed. As a result, unnecessary loosening between the toy doll 5 and the exterior 30 can be prevented.

After mounting the exterior 30 onto the toy doll 5, as shown in FIGS. 3 and 4, the accessories 6 are then mounted onto both arm sections of the toy doll 5 respectively, the wheel half portions 7A, 7B of the wheel 7 are mounted onto the shoulders of the toy doll 5 respectively, and the engine constituent parts 12A, 12B are mounted onto both sides of the front frame 13A via the fitting structure respectively.

In the foregoing embodiment, a first assembly constituent section includes the front cover 15, front fork 14, and front frame 13A of the autobicycle. The first assembly constituent section is disposed mainly in a front side 5*e* of the toy doll 5. The second assembly constituent section includes the fuel tank 11, the sitting portion 8, the rear frame 13B, and the rear cover 17. The second assembly constituent section is connected to the first assembly constituent section and disposed in a back side 5*f* of the toy doll 5. The third assembly constituent section includes the handle 16. The third assembly constituent section works to connect the first and second assembly constituent sections.

Next, the shin sections and the foot sections of the leg sections of the toy doll 5 are inserted into holes of the two muffler constituent sections 19, 21. The holes are formed at the end portions near step portions 20 respectively. The other end portions (opposite to the end portions near the step portions 20) of the two muffler constituent sections 19 and 21 are provided with components 26 for constituting heel sections 25 and components 28 for constituting tiptoe sections 27 of the foot sections in a transformable way for the case of using muffler constituent sections 19, 21 as shin sections 22A, 24A and as the foot sections of the toy robot 23.

Figure 11A:
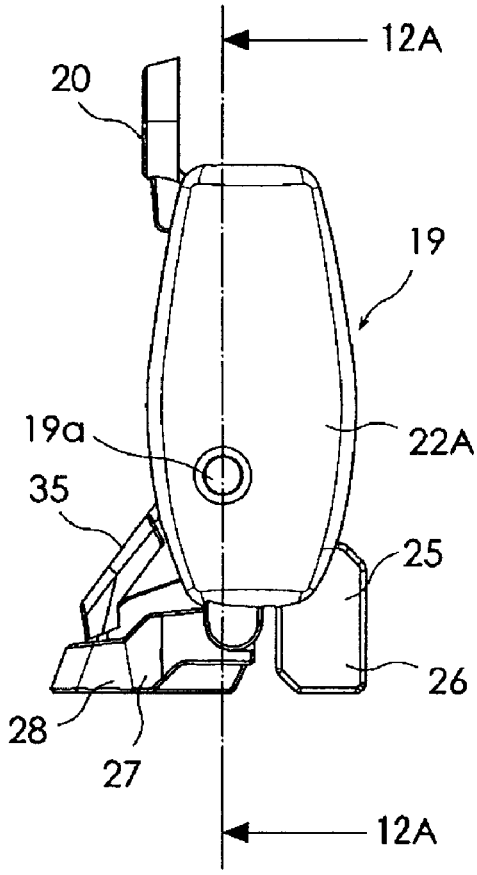
FIGS. 11A and 11B are a side elevation view and a back elevation view showing a state in which a muffler constituent section has been transformed to constitute a leg section of the toy robot.
Figure 11B:
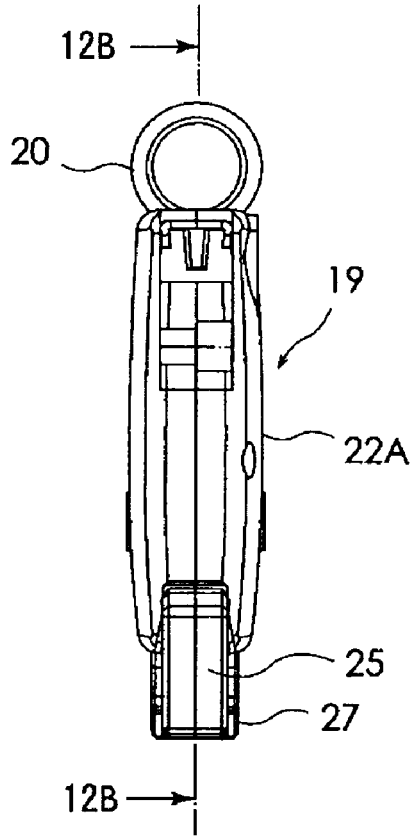
Figure 12A:
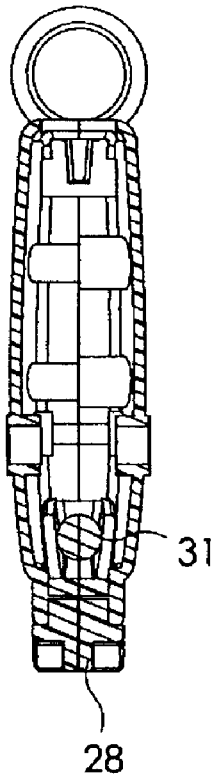
FIGS. 12A and 12B are sectional views taken along line VIA-VIA of FIG. 11A and taken along line VIB-VIB of FIG. 11B respectively.
Figure 12B:
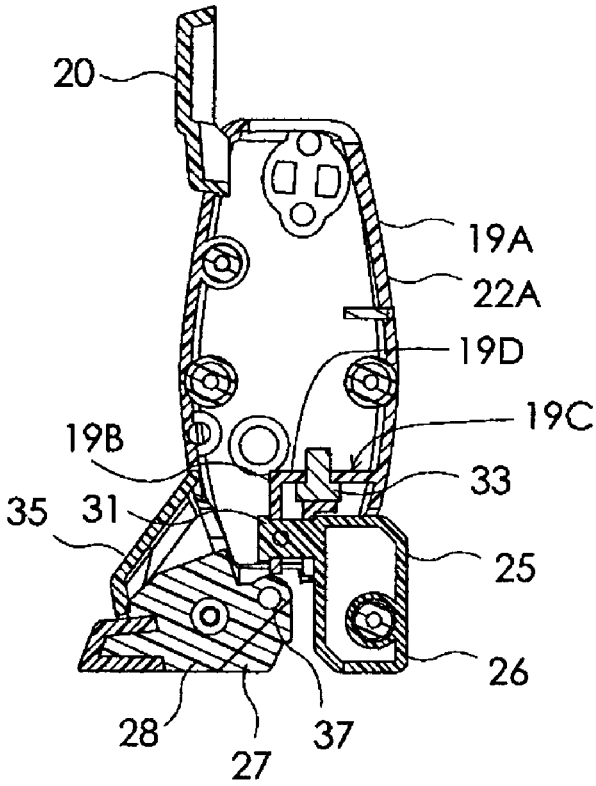

FIGS. 11A and 11B respectively show a side elevation view and a back elevation view in a state where the muffler constituent section 19 is transformed to constitute the leg section 22 of the toy robot 23. FIG. 12A shows a sectional view taken along line VIA-VIA of FIG. 11A, and FIG. 12B shows a sectional view taken along line VIB-VIB of FIG. 11B. A muffler constituent body 19A of the muffler constituent section 19 is constituted by assembling two mold half portions. As well shown in FIG. 12B, a partition wall 19C, which has a wall part 19B extending in a vertical direction (a longitudinal direction of the shin section 22A) of the constituent body 19A, is formed in the interior of the constituent body 19A which constitutes the shin section 22A of the toy robot 23. On the wall part 19B is arranged a shaft 31 orthogonal to the wall part 19B (orthogonal to the longitudinal direction of the shin section) and extending in a direction in which the component 28 for constituting the tiptoe section 27 and the component 26 for constituting the heel section 25 are disposed side by side. The shaft 31 is arranged integrally with the component 26 for constituting the heel section 25. The component 26 for constituting the heel section 25 is constituted by two mold half portions including the portion which constitutes the shaft 31. Since the shaft 31 is rotatably supported by the wall part 19B, the components 26 for constituting the heel section 25 can swing right and left in a predetermined angular range with respect to the shaft 31.

A raised portion 33 for fitting into the end portion of the leg section of the toy doll 5 is arranged on a side wall 19D of the partition wall 19C extending in a lateral direction. At the end portions of the leg sections of the toy doll 5, a fitted hole is formed where the raised portion 33 is received.

The component 28 for constituting the tiptoe section 27 is rotated on a shaft 37 of which ends are fixed to a pair of opposed side walls of the constituent body 19A. FIG. 11 shows the component 28 for constituting the tiptoe section which 27 has been rotated 90 degrees. In this state, a portion 35 of the constituent body 19A which constitutes the shin section 22A opens forward, and the end portion thereof is disposed on the component 28 for constituting the tiptoe section 27. The portion 35 of the constituent body 19A is connected to the constituent body 19A via a conventional hinge mechanism.

Figure 13:
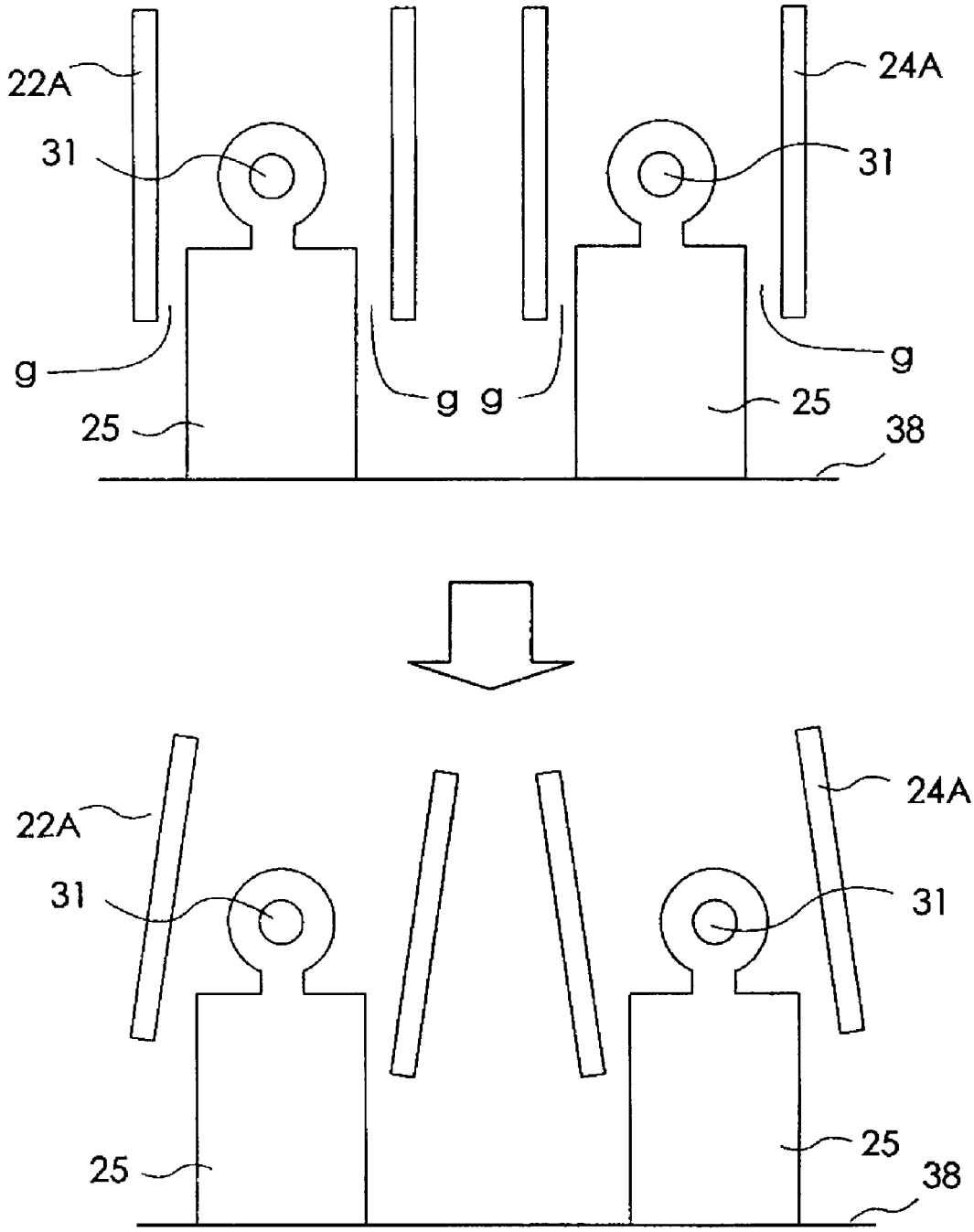
FIG. 13 is a view used to conceptually explain a movement of a heel mounting mechanism of the present embodiment.

Between the component 26 for constituting the heel section 25 and the pair of opposed side walls of the constituent body 19A, a clearance g is formed (refer to FIG. 13), thereby allowing the component 26 to swing in the predetermined angular range with respect to the shaft 31. A width of the clearance g is determined based on an intended angle range by which the toy robot 23 opens (inclines) its pair of leg sections (19, 21) laterally (in the right and left direction when the toy robot 23 is seen from the front). FIG. 13 conceptually shows that the heel section 25 can have its bottom face in full contact with a setting surface 38 even when the leg sections 22, 24 of the toy robot are inclined in the lateral or right/left directions. The leg sections of toy robot 23 can be opened in the right and left direction wider until the components 26 for constituting the heel section s 25 and the side walls of the constitution body 19A, 21A which constitute the shin sections 22A, 24A of the toy robot 23 contact with each other. Therefore, the above-mentioned clearance g is arbitrarily determined based on the opening angle of the leg sections.

A heel mounting mechanism according to the present embodiment is theoretically constituted by the shaft 31 and the wall part 19B rotatably supporting the shaft 31. The wall part 19B constitutes a shaft supporting structure. The heel mounting mechanism is constructed in such a manner that the heel sections 25 can move with respect to the shin sections (22A, 24A) so that the whole bottom faces of the heel sections 25 can be in full contact with the setting surface whenever the pair of leg sections 22, 24 of the toy robot 23 are opened right and left, or closed, as seen from the front. In this manner, even when the toy robot having a heavily mounted upper body is installed on the setting surface 38 with the legs opened, it is possible to keep the toy standing in a stabilized condition.

Figure 14:
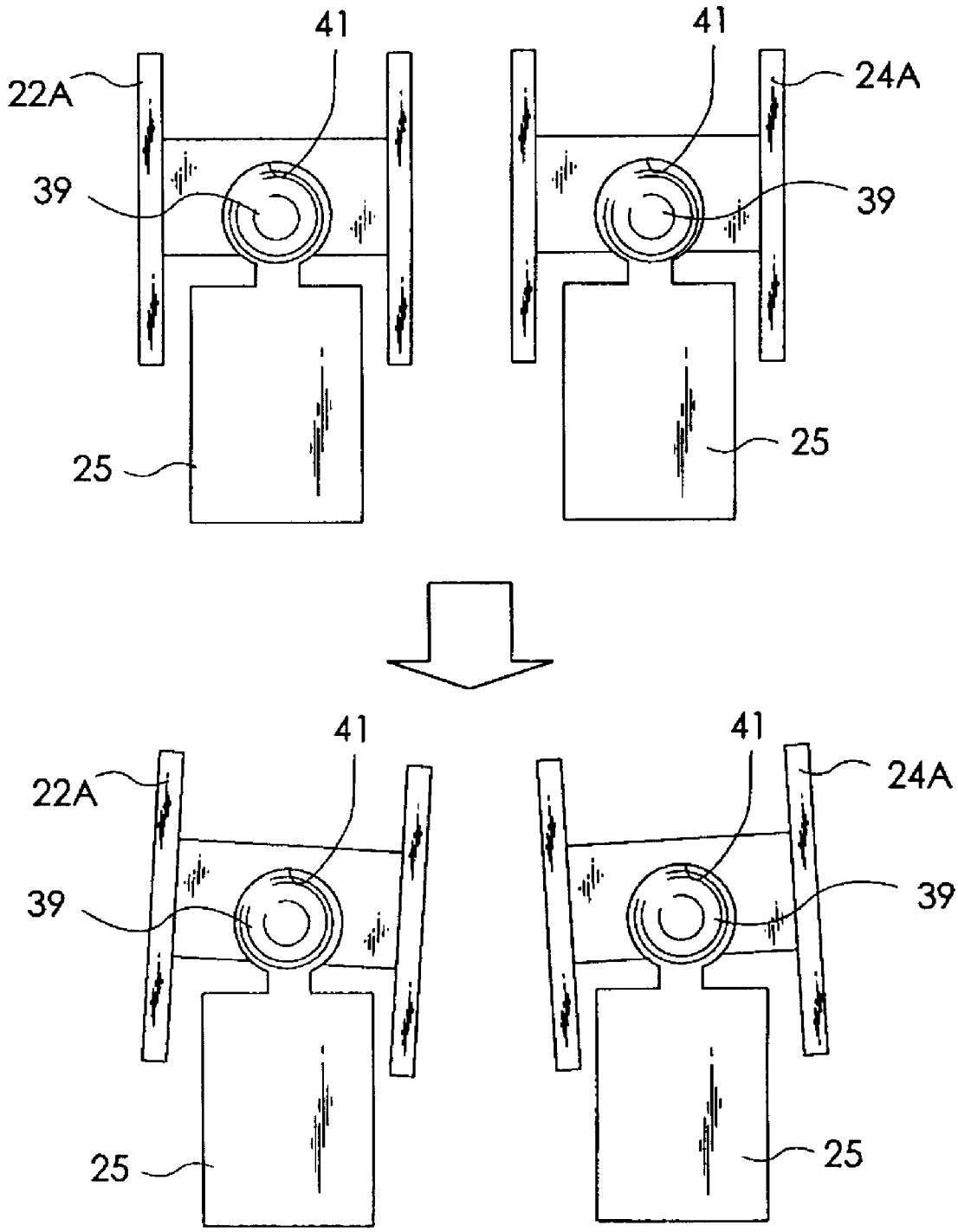
FIG. 14 is a view used to conceptually explain a movement of a variation of the heel mounting mechanism.

The heel mounting mechanism may be constructed so that the heel sections 25 can be inclined back and forth with respect to the shin sections as the shin sections are seen from the tiptoe side. In order to realize such a movement, as conceptually shown in FIG. 14, the heel mounting mechanisms are constructed using spherical portions 39, 39 which are integrally arranged on the components 26 for constituting the heel sections 25 and spherical seats 41, 41 arranged in the constituent bodies (19A, 21A) for rotatably receiving the spherical portions 39. Even if constructed in this way, since a part of the tiptoe sections 27 contact the setting surface independently of the heel sections 25 and a movement of the heel sections 25 is controlled because the pair of opposed sidewalls of the constituent bodies (19A, 21A) contact the heel sections 25, the heel mounting mechanisms is not moved unfavorably even if some external force is applied.

The two wheels 7, 9 of the autobicycle can be divided into two (can be halved) in the direction orthogonal to the axle according to the above-mentioned embodiment. The wheel half portions, which are constituted by dividing the two wheels into two, are mounted onto both of the shoulders and both of the shin sections of the toy robot. One of the wheel half portions is omitted from the illustration. Since the wheels can be mounted onto the toy robot like a part of armor for the toy robot in this manner, an image of the autobicycle before transformation can be considerably faded out and transformation degree of the transformable toy can be further increased. Although the autobicycle is used as the movable toy according to the above-mentioned embodiment, the present invention can also be applied to a transformable toy using other movable toys such as an airplane and a vessel. In the above-mentioned embodiment, although the toy foot structure of the toy robot capable of standing on two feet is employed in the present invention, the toy foot structure of the present invention may be applied to a foot structure for a toy robot having four legs, and the number of the legs is not limited.

INDUSTRIAL APPLICABILITY

According to the present invention, an unprecedented process of transformation can be enjoyed, and the assembly constituting a part of the movable toy is transformed into an unpredictable figure. Consequently, the interest of transformable toy lovers can be increased substantially.

The present invention also has such an advantage that even when the toy is installed on the setting surface with its legs opened right and left, the toy can maintain its standing state in a more stabilized condition than ever.

The invention claimed is:

1. A transformable toy, the figure of which can be changed from a state where a toy doll is riding on an autobicycle movable toy to a toy robot having a configuration different from that of the toy doll by transforming at least a part of the autobicycle movable toy and mounting it on the toy doll, the autobicycle movable toy including an assembly composed of a plurality of components, the assembly being mounted onto an upper body of the toy doll to constitute an exterior for an upper body of the toy robot, the assembly including a first assembly constituent section mainly disposed in a front side of the toy doll; a second assembly constituent section connected to the first assembly constituent section and disposed in a back side of the toy doll; and a third assembly constituent section connecting the first and second assembly constituent sections, each of the first, second and third assembly constituent sections being composed of the one or more components, the first, second and third assembly constituent sections being assembled together in an annular shape to constitute the exterior of the toy doll, the exterior surrounding at least shoulders, a crotch, the front side and the back side of the toy doll, the first assembly constituent section including a front cover, a front fork, and a front frame of the autobicycle; the second assembly constituent section including a fuel tank, a sitting portion, a rear frame, and a rear cover; and the third assembly constituent section including a handle, at least the front frame and the rear frame being rotatably connected, the fuel tank being constituted by assembling two tank half portions that can be separated apart right and left, and the two tank half portions being attached to the rear frame in such a manner that the front frame can pass through between the two tank half portions which are separated apart left and right when assembling the first, second and third assembly constituent sections in the annular shape.

2. The transformable toy according to claim 1, wherein an engaged portion is arranged in the back side of the toy doll, a cover part of the rear cover, which is located by the side of the sitting portion, is supported by a rear cover body of the rear cover in such a manner that the cover part can be turned over, and an engaging portion engaging with the engaged portion of the toy doll is arranged in a turned-over side of the cover part.

3. The transformable toy according to claim 1, wherein a construction of the handle and a construction of the rear cover are defined so that end portions of a pair of arm parts of the handle can engage with the rear cover to constitute the exterior in the annular shape, and the handle can be located over the shoulders of the toy doll.

4. The transformable toy according to claim 1, wherein the front frame and the front fork are connected to rotate in a predetermined angular range and the rear frame and the rear cover are connected to rotate in a predetermined rotation range.

5. A transformable toy, the figure of which can be changed from a state where a toy doll is riding on an autobicycle movable toy to a toy robot having a configuration different from that of the toy doll by transforming a part of the autobicycle movable toy and mounting it on the toy doll, the autobicycle movable toy including at least a pair of shin section constituents composed of one or more components and attached to a pair of leg sections of the toy doll, the pair of shin section constituents constituting shin sections of the pair of leg sections for the toy robot; and an assembly composed of a plurality of components and attached to an upper body of the toy doll to constitute an exterior for an upper body of the toy robot, the assembly including a first assembly constituent section mainly disposed in a front side of the toy doll; a second assembly constituent section connected to the first assembly constituent section and disposed in a back side of the toy doll; and a third assembly constituent section connecting the first and second assembly constituent sections and disposed on shoulders of the toy doll so that a head section of the toy doll can be exposed, each of the first, second and third assembly constituent sections being composed of the one or more components, the first, second and third assembly constituent sections being assembled together in an annular shape to constitute the exterior of the toy doll, the exterior surrounding the shoulders, a crotch, the front side and the back side of the toy doll except the leg sections, arm sections and the head section thereof, the first assembly constituent section including a front cover, a front fork, and a front frame of the autobicycle; the second assembly constituent section including a fuel tank, a sitting portion, a rear frame, and a rear cover; and the third assembly constituent section including a handle, at least the front frame and the rear frame being rotatably connected, the fuel tank being constituted by assembling two tank half portions that can be separated apart right and left, and the two tank half portions being attached to the rear frame in such a manner that the front frame can pass through between the two tank half portions which are separated apart left and right when assembling the first, second and third assembly constituent sections in the annular shape.

6. The transformable toy according to claim 5, wherein an engaged portion is arranged in the back side of the toy doll, a cover part of the rear cover, which is located by the side of the sitting portion, is supported by a rear cover body of the rear cover in such a manner that the cover part can be turned over, and an engaging portion engaging with the engaged portion of the toy doll is arranged in a turned-over side of the cover part.

7. The transformable toy according to claim 5, wherein a construction of the handle and a construction of the rear cover are defined so that end portions of a pair of arm parts of the handle can engage with the rear cover to constitute the exterior in the annular shape, and the handle can be located over the shoulders of the toy doll.

8. The transformable toy according to claim 5, wherein the front frame and the front fork are connected to rotate in a predetermined angular range and the rear frame and the rear cover are connected to rotate in a predetermined rotation range.

9. The transformable toy according to claim 5, wherein the pair of shin section constituents are a pair of muffler constituent sections of the autobicycle.

10. The transformable toy according to claim 9, wherein each of two wheels of the autobicycle has a construction that can be divided into two parts in a direction orthogonal to the wheel's axle to form wheel half portions, and the wheel half portions of the two wheels are mounted onto the exterior and/or both of the shin sections of the toy robot respectively.

11. A transformable toy, the figure of which can be changed from a state where a toy doll is riding on an autobicycle movable toy to a toy robot having a configuration different from that of the toy doll by transforming a part of the autobicycle movable toy and mounting it on the toy doll, the autobicycle movable toy including at least a pair of shin section constituents composed of one or more components and attached to a pair of leg sections of the toy doll, the pair of shin section constituents constituting shin sections of the pair of leg sections for the toy robot; and an assembly composed of a plurality of components and attached to an upper body of the toy doll to constitute an exterior for an upper body of the toy robot, the assembly including a first assembly constituent section mainly disposed in a front side of the toy doll; a second assembly constituent section connected to the first assembly constituent section and disposed in a back side of the toy doll; and a third assembly constituent section connecting the first and second assembly constituent sections, each of the first, second and third assembly constituent sections being composed of the one or more components, the first, second and third assembly constituent sections being assembled together in an annular shape to constitute the exterior of the toy doll, the exterior surrounding at least shoulders, a crotch, the front side and the back side of the toy doll, the pair of shin section constituents being deformably constituted to form a toy foot structure that includes a shin section and a foot section having a tiptoe section and a heel section for the toy robot; and a heel mounting mechanism that attaches the heel to the shin section, the heel mounting mechanism being constructed in such a manner that the heel section can move with respect to the shin section so that a whole bottom face of the heel section can be in full contact with a setting surface whenever the pair of leg sections of the toy robot are opened right and left, or closed, as seen from the front, the first assembly constituent section including a front cover, a front fork, and a front frame of the autobicycle; the second assembly constituent section including a fuel tank, a sitting portion, a rear frame, and a rear cover; and the third assembly constituent section including a handle, at least the front frame and the rear frame being rotatably connected, the fuel tank being constituted by assembling two tank half portions that can be separated apart right and left, and the two tank half portions being attached to the rear frame in such a manner that the front frame can pass through between the two tank half portions which are separated apart left and right when assembling the first, second and third assembly constituent sections in the annular shape.

12. The transformable toy according to claim 11, wherein the heel mounting mechanism includes a shaft orthogonal to a longitudinal direction of the shin section and extending in a direction where the tiptoe section and the heel section are disposed side by side so that the heel section can swing in a predetermined angular range with respect to the shaft.

* * * * *